US009358809B2

(12) United States Patent
Biegelsen

(10) Patent No.: US 9,358,809 B2
(45) Date of Patent: Jun. 7, 2016

(54) MICROWAVE DRYING OF INK FOR AN INK JET PRINTER

(71) Applicant: Palo Alto Research Center Incorporated, Palo Alto, CA (US)

(72) Inventor: David K. Biegelsen, Portola Valley, CA (US)

(73) Assignee: PALO ALTO RESEARCH CENTER INCORPORATED, Palo Alto, CA (US)

( * ) Notice: Subject to any disclaimer, the term of this patent is extended or adjusted under 35 U.S.C. 154(b) by 0 days.

(21) Appl. No.: 14/163,601

(22) Filed: Jan. 24, 2014

(65) Prior Publication Data

US 2015/0210089 A1 Jul. 30, 2015

(51) Int. Cl.
*B41J 2/01* (2006.01)
*B41J 11/00* (2006.01)

(52) U.S. Cl.
CPC ..... *B41J 11/002* (2013.01)

(58) Field of Classification Search
USPC ..... 347/102; 219/678–763; 34/259
See application file for complete search history.

(56) References Cited

U.S. PATENT DOCUMENTS

| | | | | |
|---|---|---|---|---|
| 4,684,238 | A | 8/1987 | Radulski et al. | |
| 5,422,463 | A | 6/1995 | Gooray et al. | |
| 5,563,644 | A | 10/1996 | Isganitis et al. | |
| 5,585,905 | A | 12/1996 | Badesha et al. | |
| 5,631,685 | A | 5/1997 | Gooray et al. | |
| 5,712,672 | A | 1/1998 | Gooray et al. | |
| 6,265,702 | B1 | 7/2001 | Drozd et al. | |
| 6,425,663 | B1 | 7/2002 | Eastlund et al. | |
| 6,590,191 | B2 | 7/2003 | Drozd et al. | |
| 6,753,516 | B1 | 6/2004 | Butler et al. | |
| 6,901,683 | B2 * | 6/2005 | Lyle | F26B 3/343 219/690 |
| 7,992,990 | B2 * | 8/2011 | Yamashita | B41J 2/0057 347/102 |
| 8,215,762 | B2 | 7/2012 | Ageishi | |
| 8,288,694 | B2 | 10/2012 | Ristola et al. | |
| 8,328,307 | B2 | 12/2012 | VanKouwenberg et al. | |
| 2007/0079719 | A1 * | 4/2007 | Rohde et al. | 101/487 |
| 2012/0279766 | A1 | 11/2012 | Wu | |

FOREIGN PATENT DOCUMENTS

| | | |
|---|---|---|
| EP | 2639653 | 9/2013 |
| WO | WO2006053083 | 5/2006 |
| WO | WO2008150644 | 12/2008 |

* cited by examiner

*Primary Examiner* — An Do
*Assistant Examiner* — Renee I Wilson
(74) *Attorney, Agent, or Firm* — Hollingsworth Davis, LLC

(57) ABSTRACT

An ink jet printer includes a microwave transparent substrate, a microwave emitter, and at least one cavity. The microwave transparent substrate is operationally movable along a first direction and is adapted to receive an ink jetted material thereon. The microwave emitter is configured to emit microwave energy at a wavelength (λ). The at least one cavity has an outlet disposed adjacent the microwave transparent substrate and is adapted to receive and output an amount of the microwave energy at the outlet to reduce a moisture content of the ink jetted material. The amount of microwave energy output to the ink jetted material is substantially constant as measured along a second direction transverse to the first direction.

20 Claims, 6 Drawing Sheets

MICROWAVE DRYING OF INK FOR AN INK JET PRINTER

BACKGROUND

In ink jet printing, a relatively large quantity of ink is deposited onto the print medium in a relatively short period of time. Often, there is a time lapse between the completion of printing a portion of an image and ink drying in that portion. This phenomenon can be problematic in humid environments, where ink drying times are extended. Furthermore, heat dissipated in parts of the printer, other than in the ink itself, incurs higher power consumption than is minimally necessary for ink drying.

Although ink jet printers are generally suitable for their intended purpose, ink jet printing processes with rapid output rates (i.e. reduced ink drying times) are desirable. Various methods of drying the ink to meet the rapid output rate have been developed but these methods can be rather inefficient at coupling heat to the ink jetted material.

SUMMARY

Some embodiments discussed in the disclosure are directed to an ink jet printer that includes a microwave transparent substrate (having low microwave absorption), a microwave emitter, and at least one cavity. The microwave transparent substrate is operationally movable along a first direction and is adapted to receive an ink jetted material thereon. The microwave emitter is configured to emit microwave power at a wavelength (λ). The at least one cavity has an outlet disposed adjacent the microwave transparent substrate and is adapted to receive and output an amount of the microwave power at the outlet to excite molecules within the ink jetted material and reduce a moisture content of the ink jetted material. The total amount of microwave power output to the ink jetted material is substantially constant as measured along a second direction transverse to the first direction.

In another aspect, a method for reducing a moisture content of ink jetted material includes providing a microwave apparatus and a microwave transparent substrate, the microwave transparent substrate is operationally movable along a first direction relative to the microwave apparatus to transport the ink jetted material, and exposing the ink jetted material to an amount of power produced by the microwave apparatus, the power is modally averaged along a second direction transverse to the first direction in a manner to provide the same integrated power at each location in the cross process direction.

According to other aspects, a system for reducing a moisture content of the ink jetted material includes a microwave transparent substrate and a microwave apparatus. The microwave transparent substrate is operationally movable along a first direction and is adapted to receive an ink jetted material on a first surface. The microwave apparatus has an interaction region with the microwave transparent substrate and the ink jetted material. The microwave apparatus is configured such that an integrated microwave power in the interaction region is substantially constant as measured along a second direction transverse to the first direction.

DETAILED DESCRIPTION

Figure 1A:
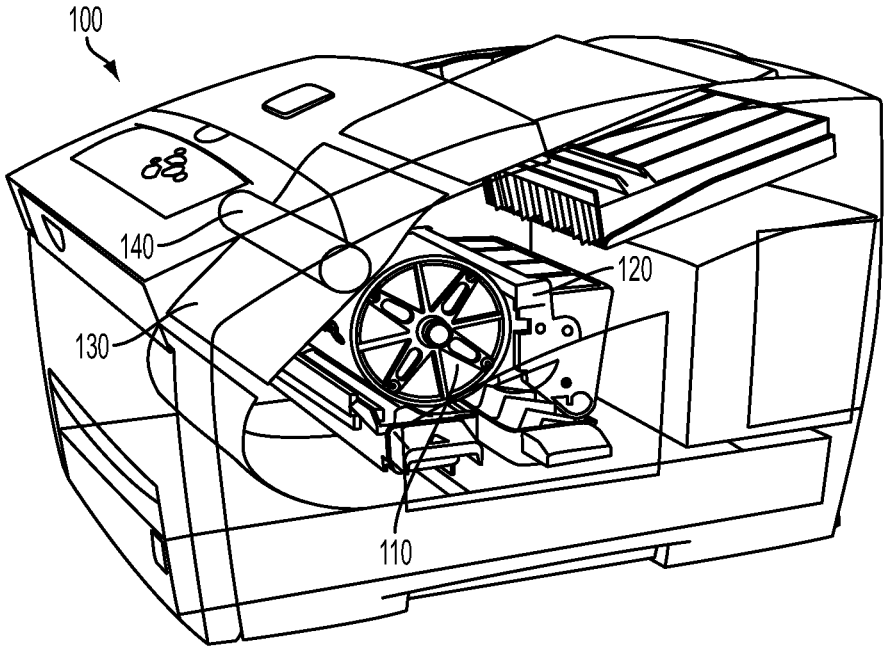
FIGS. 1A and 1B provide internal views of portions of an ink jet printer that includes an intermediate belt and a microwave drying apparatus in accordance with various embodiments.

In the following description, reference is made to the accompanying set of drawings that form a part of the description hereof and in which are shown by way of illustration several specific embodiments. It is to be understood that other embodiments are contemplated and may be made without departing from the scope of the present disclosure. The following detailed description, therefore, is not to be taken in a limiting sense.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein. The use of numerical ranges by endpoints includes all numbers within that range (e.g. 1 to 5 includes 1, 1.5, 2, 2.75, 3, 3.80, 4, and 5) and any range within that range.

Embodiments described herein involve approaches that enable rapid targeted substantially uniform heating to reduce a moisture content of an ink jetted material disposed on a microwave transparent substrate of an ink jet printer. Microwave energy drying has characteristics that make it appealing over more conventional heating systems. Conventional heating systems generally rely on the thermal conductivity of the belt to transport heat energy to ink jetted material disposed on the surface of the belt. Many belts comprise drums that have traditionally been made of metal with a significant thermal capacity, which makes the drum slow to be heated whenever prints are requested. If the drum is kept at the elevated temperature at all times, heat loss from its surface is substantial, and leads to significant power consumption in idle mode. Thus, metal drum printers may be either rather inefficient or slow responding, which can limit their competitiveness in today's markets. In contrast, the use of microwave energy to be absorbed predominantly by a component of the ink may result in very rapid targeted and self-limited heating.

In a printing process it is important that all image areas receive the same treatment, so that image quality is uniform. Microwave heating as applied to the printing process has generally encountered a problem arising from non-uniform power distribution in the cross-process direction due to standing wave peaks and nodes. In one approach to ameliorate this problem, modes of the cavity were modified (mode stirring, frequency sweeping, etc.) with the goal that a given area sees an average power over time that is the same at all places. However, mode stirring at rates necessary for rapid printing is not available and modal averaging is generally not adequate to provide uniform total power at all locations. Another microwave heating approach uses traveling wave power. However, such traveling waves are attenuated as they travel and interact with the material. By passing the traveling waves back and forth across the material the attenuation is opposite for the pair of passes. If the losses were linear, the summation of powers at a given position in the cross-process direction would sum to a constant value. However, the absorption is generally exponential and thus does not sum to a constant value. Thus, ink at one location is processed differently from at another. The present disclosure utilizes a pair of cavities running in the cross-process direction. Offsetting the cavities by an odd number of quarter wavelengths and summing the powers at any given cross-process location provides accurately constant power. With such pairing, various configurations can be used.

Some approaches discussed herein involve a microwave apparatus that includes one or more cavities adapted to use standing waves to facilitate drying. In some cases, the microwave power output to the ink jetted material is substantially constant (i.e. modally averaged) independent of ink jetted material position as measured along a cross-process direction (i.e. a direction transverse to a process direction that is the direction of travel of the microwave transparent substrate). Some of the embodiments described below utilize various devices and techniques for tuning a frequency and/or amplitude of energy produced by the microwave apparatus to reduce the moisture content of the ink jetted material to a desired level. The microwave drying techniques described herein allow for reduced heating times, reduced energy usage because energy is absorbed predominantly by the material for which heating is desired, and substantially uniform heat application to dry ink jetted material to a desired moisture content.

Figure 1B:
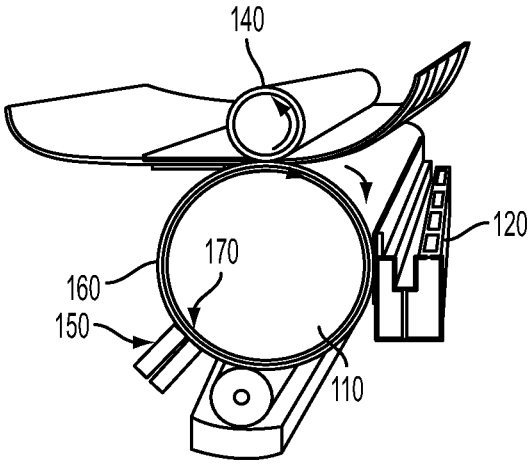

FIGS. 1A and 1B provide internal views of portions of an exemplary ink jet printer 100 that incorporates various embodiments of a microwave apparatus as discussed herein. The ink jet printer 100 includes transport mechanisms including a belt 110. The belt 110 is operationally moveable relative to a print head 120. Additionally, paper 130 is capable of being transported relative to the belt 110.

The print head 120 may extend fully or partially along the length of the belt 110 and includes a number of ink jets. As the belt 110 is rotated by the transport mechanisms, ink jets of the print head 120 deposit droplets of ink though ink jet apertures either directly onto the belt 110 or onto an intermediate substrate in a desired pattern. In some instances, various transport mechanisms may be used to automatically feed sheets of paper 130 from an input tray onto the belt 110 and automatically withdraw printed sheets of paper from the belt 110 to an output tray. As each sheet of paper 130 travels over the belt 110, the pattern of ink on the belt 110 is transferred to the paper 130 through a pressure nip 140.

As shown in FIG. 1B, in some embodiments the microwave apparatus 150 may be mounted adjacent the belt 110. A microwave transparent substrate 160 is disposed along the belt 110 between the belt 110 and the microwave apparatus 150. The microwave transparent substrate 160 can have an absorption of the microwave power per unit area that is significantly smaller than the initial absorption per unit area of the deposited ink. A ratio for the substrate absorption to ink absorption of 0.1 or less is desirable in some instances. Higher values, such as 1, are acceptable in some configurations. The microwave transparent substrate 160 is operationally movable along a first direction (as indicated by an arrow) and is adapted to receive the ink jetted material thereon from the print head 120. The microwave apparatus 150 has an interaction region 170 with the microwave transparent substrate 160 and the ink jetted material disposed thereon where microwave energy is used to reduce a moisture content of the ink jetted material. As will be discussed subsequently, microwave power output to the interaction region 170 is substantially constant as measured along a second direction (i.e. the cross-process direction) that is transverse to the first direction (i.e. the direction of travel of the microwave transparent substrate 160). Although not shown in the embodiment of FIG. 1B, the belt 110 can be hollow and all or a portion of the microwave apparatus 150 can be disposed within a guiding structure in some instances. In other cases, the belt may not be utilized and/or microwave energy can be applied upstream or downstream in the printing process direction from the belt. For example, in some instances ink jetted material can be jetted directly onto the final substrate, e.g. paper 130, and microwave power can be applied to the ink jetted material on the paper 130. Thus, in some embodiments, the microwave transparent substrate 160 can include the paper 130.

Figure 2:
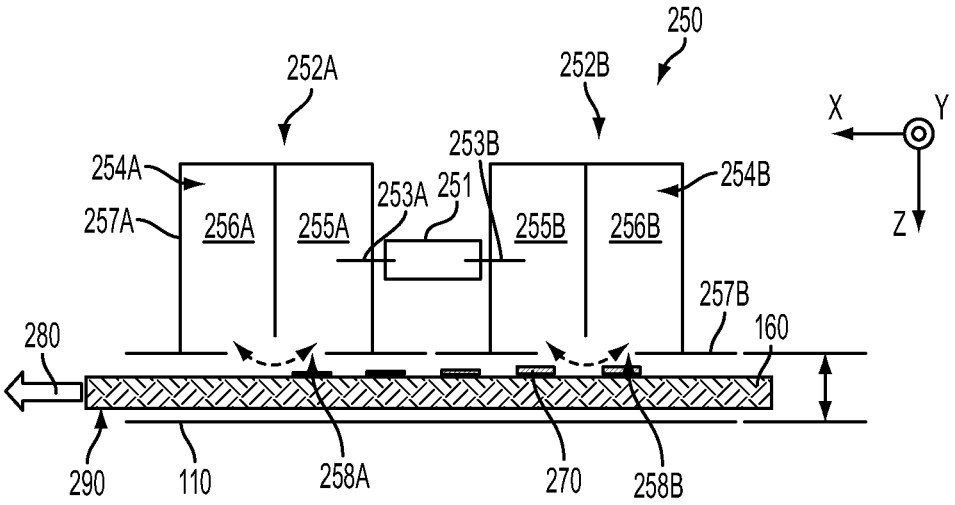
FIG. 2 is a cross-sectional view of one embodiment of a microwave apparatus, a microwave transparent substrate, and a portion of the belt.

FIG. 2 shows a cross-sectional view of one embodiment of a microwave apparatus 250, the microwave transparent substrate 160, the belt 110, and ink jetted material 270. The microwave apparatus 250 includes a microwave emitter 251, a first housing 252A, a second housing 252B, a first coupler 253A, and a second coupler 253B. The first housing 252A includes a first resonant cavity 254A that further includes a launch cavity 255A, a reflecting cavity 256A. The first housing 252A also includes walls 257A and a slot 258A. The second housing 252B includes a second resonant cavity 254B that further includes a launch cavity 255B, a reflecting cavity 256B. The second housing 252B also includes walls 257B and a slot 258B.

In FIG. 2, the microwave emitter 251 comprises a magnetron or other source of microwave power that is disposed between the first housing 252A and the second housing 252B. The microwave emitter 251 is operationally configured to emit power to both the first resonant cavity 254A and the second resonant cavity 254B via respective first and second couplers 253A and 253B. Commercial coaxial cables (not shown) having a construction suitable for microwave transmission can also be used in some instances. The first coupler 253A extends from the microwave emitter 251 into the launch cavity 255A. The second coupler 253B extends from the microwave emitter 251 into the launch cavity 255B. Although described in reference to a magnetron, the microwave emitter 251 can comprise microwave generators such as a klystron, a gyrotron, or a traveling wave tube in some embodiments. Similarly, rather than a single waveguide providing microwave energy to two launching cavities, in some embodiments each housing will have a dedicated microwave emitter, or alternatively, multiple emitters can be used for each housing as desired.

In some cases, microwave emitter 251 can be configured to have an output center frequency at approximately 2.45 GHz. 2.45 GHz is an allowed industrial use frequency band and microwave emitters designed for this frequency are widely and inexpensively available. However, output center microwave frequencies other than 2.45 GHz can be utilized in some embodiments as desired. For example, the microwave emitter 251 can have an output center frequency between 0.9 GHz to 100 GHz in some instances.

The first and second housings 252A and 252B shown in the embodiment of FIG. 2 have an identical shape and same construction. Thus, references made in the following passages to the particulars of components of the first housing 252A will also be applicable to the second housing 252B. The first housing 252A has walls 257A that define the first resonant cavity 254A. In particular, the walls 257A can include a central divider wall that separates portions of the launch cavity 255A and the reflecting cavity 256A. However, the central divider does not entirely enclose the launch cavity 255A from the reflecting cavity 256A as the slot 258A allows for communication of microwave energy therebetween, as well as to select portions of the microwave transparent substrate 160, the belt 110, and the ink jetted material 270 as will be discussed subsequently.

In one example embodiment, the launch cavity 255A and the reflecting cavity 256A have an interior dimension (shown as a height in FIG. 2) measured in the z direction of about (1)*λ, where λ is the wavelength of microwave energy produced by the microwave emitter 251. Similarly, the launch cavity 255A and the reflecting cavity 256A have an interior dimension (shown as a width in FIG. 2) measured in the x direction of about (½)*λ. The dimensions of the launch cavity 255A and the positioning of the first waveguide 253A are determined by known microwave principles of wave launching and are provided for exemplary purposes.

The portion of the walls 257A disposed adjacent the microwave transparent substrate 160 is configured as a flange and partially encloses the launch cavity 255A and the reflecting cavity 256A from the microwave transparent substrate 160, the belt 110, and the ink jetted material 270. The flange sections can act as attenuators to prevent microwave power leakage into the environment. However, the flange portion of the walls 257A forms the slot 258A, which comprises an outlet antenna from the first resonant cavity 254A to the microwave transparent substrate 160 and the ink jetted material 270 disposed thereon. Additionally, the walls 257A can be used to mount the first housing 252A to portions of ink jet printer 100 (FIG. 1A) and provide a path for transfer of microwave energy back and forth (as illustrated by arrow) between the launch cavity 255A and the reflecting cavity 256A.

In the embodiment illustrated in FIG. 2, the microwave transparent substrate 160 is positioned adjacent the slot 258A (outlet) of the first resonant cavity 254A between the belt 110 and the first housing 252A. The microwave transparent substrate 160 can be comprised of various materials such as a dielectric polymer material that has low microwave absorptivity and is substantially transparent to the microwave energy. Many plastics such as PTFE, glass reinforced nylon, or rubbers are effectively transparent to microwave energy. The ink jetted material 270 is disposed upon a first surface of the microwave transparent substrate 160. In other cases, the ink jetted material 270 can be disposed on two or more closely spaced surfaces of the microwave transparent substrate 160 (e.g., in a two-sided ink jetting and simultaneous drying operation). During operation, the microwave transparent substrate 160 moves in a first direction (a process direction indicated by arrow 280) along with the belt 110 to transport the ink jetted material 270 relative to the microwave apparatus 250 and other components. The ink jetted material 270 comprises a swath of ink droplets having a moisture content extending along the microwave transparent substrate 160 in both the x and y directions of the Cartesian coordinate system illustrated in FIG. 2. As the ink jetted material 270 enters the interaction region where microwave energy is present (adjacent the slots 258A and 258B and along portions of the cavity 290 that house the microwave transparent substrate) absorption of the microwave energy by the ink heats and evaporates the ink jetted material 270, drying ink to a desired level of moisture content. Each of the first and the second housings 252A and 252B generates an interaction region where microwave frequency oscillating fields extend into and through the microwave transparent substrate 160.

In operation, microwave energy is produced by the microwave emitter 251, which can be configured to emit microwave energy at a wavelength (λ). The energy is transmitted to the launch cavity 255A via first coupler 253A. The launch cavity 255A is configured to pass the microwave energy to the reflecting cavity 256A through the slot 258A to the ink jetted material 270. The reflecting cavity 256A comprises an impedance matching cavity that reflects microwave energy back to the launch cavity 255A and through the slot 258A to the ink jetted material 270. When the impedance of the reflecting cavity 256A is matched to the source, the microwave absorption by the ink jetted material 270 is enhanced, e.g., maximized, and the total energy reflected back to the microwave energy source is reduced, e.g., minimized.

It should be understood that although only one microwave apparatus 250 having two housings (the first housing 252A and the second housing 252B) is illustrated in FIG. 2, the ink jet printer 100 (FIG. 1A) can make use of a plurality of such apparatuses having one or multiple housings. It should also be understood that although shown disposed to a single side of the microwave transparent substrate 160 in FIG. 2, the microwave apparatus 250 can reside on both sides of the microwave transparent substrate 160 (see FIG. 3).

Figure 2A:
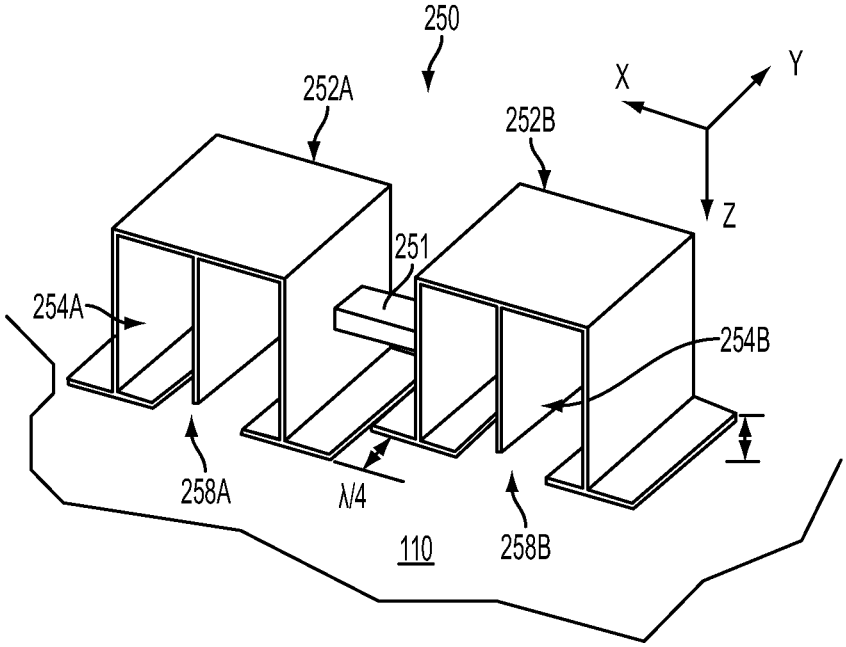
FIG. 2A is a perspective view of a portion of the microwave apparatus and belt from FIG. 2.

FIG. 2A shows a perspective view of a portion of the microwave apparatus 250 and belt 110 from FIG. 2 as they extend in both the process direction and a cross process direction. The microwave apparatus 250 illustrated in FIG. 2A includes various components previously described including the microwave emitter 251, the first housing 252A, the second housing 252B, the first resonant cavity 254A the second resonant cavity 254B, the first slot 258A and the second slot 258B. However, the microwave transparent substrate 160, and the ink jetted material 270 are not illustrated in FIG. 2A.

As discussed previously, as the ink jetted material 270 enters an interaction region where a high electric field region of the microwave field is present (adjacent the slots 258A and 258B and along portions of the cavity 290 (FIG. 2) that houses the microwave transparent substrate) absorption of the microwave energy by the ink heats and dries the ink jetted material to a desired level of moisture content.

The cross-process (y direction) ends of microwave apparatus 250 are not illustrated in FIG. 2A, however, these ends can generally be terminated in a manner known in the art (e.g., with walls, choke flanges, absorbent materials, etc.) that confine the microwaves such that a standing wave is developed in both the process and the transverse cross-process directions. If the termination is a pure resistance with value equal to the characteristic impedance of the wave guide, then power propagates from the source, through the guide, and whatever power remains is finally absorbed by the termination without reflection. In this case only there is no cross-process standing wave developed.

For the cross-process direction, the configuration illustrated in FIG. 2A generally leads to peaks and nodes of energy that are coupled to the ink jetted material as a function of a distance in the cross-process direction (y-direction). In particular, the configuration of the microwave apparatus 250 utilizes the fact that the first housing 252A and the second housing 252B are identically configured, and therefore, output substantially a same amount of energy in a same manner. To help create uniformity of energy distribution in the cross-process direction (i.e. to allow the ink jetted material at any location in the cross-process direction to receive an amount of energy that is substantially constant in the y direction) the first housing 252A is offset from the second housing 252B by a cross-process distance of $(X*\lambda)/4$, where $\lambda$ is the wavelength of the microwaves produced by the microwave emitter and X comprises an odd valued integer. If we represent the electric field in the first housing 252A as $A \sin(2\pi y/\lambda-\omega t)$, where $\omega$ is the microwave frequency and t is time, then the electric field in the second housing 252B is 90 degrees out of phase and equal to $A \cos(2\pi y/\lambda-\omega t)$. Therefore the field intensity at a distance y is $A^2 \sin^2(2\pi y/\lambda-\omega t)+A^2 \cos^2(2\pi y/\lambda-\omega t)$. Because $\sin^2(\alpha)+\cos^2(\alpha)=1$ for any value of $\alpha$ the total intensity at a cross-process position y is simply $A^2$ at all times. Thus, as the standing wave nodes are separated by $\lambda/2$, offsetting the first housing 252A from the second housing 252B by a quarter wavelength in the cross-process direction allows the power seen by the ink jetted material to be constant independent of location and time. The power seen is modally averaged and is independent of distance in the cross-process direction. As a result there are no hot spots along the y direction and essentially uniform heating.

Figure 2B:
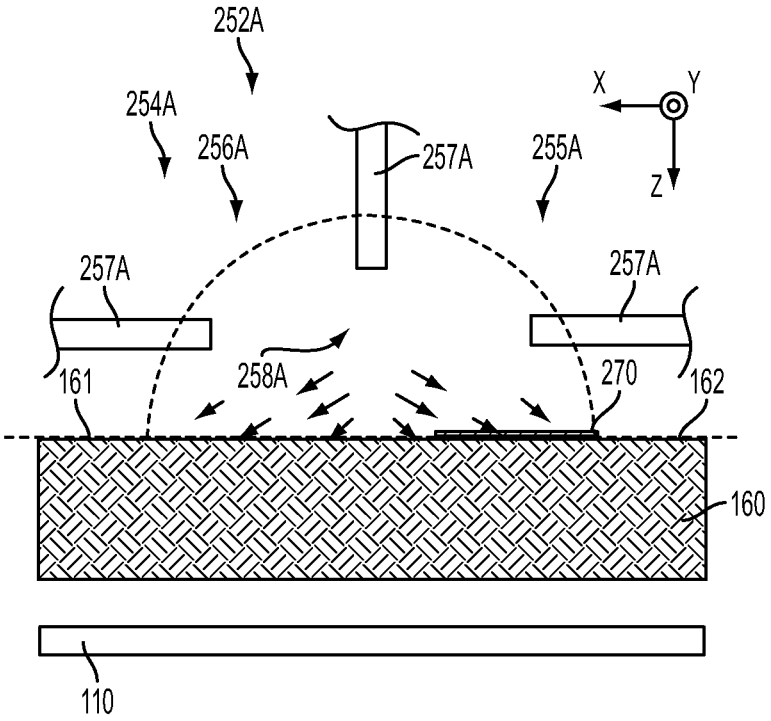
FIG. 2B is an enlarged view of a portion of the microwave apparatus and the microwave transparent substrate from FIG. 2.

FIG. 2B shows an enlargement of a portion of the first housing 252A, the microwave transparent substrate 160, the ink jetted material 270, and the belt 110. As shown in FIG. 2B, the walls 257A terminate and are spaced from one another to form the slot 258A. Slot 258A acts as an outlet from the first resonant cavity 254A and is disposed adjacent the microwave transparent substrate 160.

The microwave generated electric fields emanating from the slot 258A are illustrated in FIG. 2B. The strength and orientation of the electric fields vary across the slot 258A in the process direction. In instances where an electrically conductive material is utilized for belt 110 or a support plate for the belt or drum, and the belt 110 is disposed with a proper disposition relative to the slot 258A, (e.g. the belt 110 is disposed at a distance that comprises between 3% and 10% of $\lambda/4$) the microwave field is guided by the boundaries between the walls 257A and the belt 110 and passes through the microwave transparent substrate 160 and partially absorbed by the ink jetted material.

FIG. 2B illustrates an embodiment where the position of a first surface 161 of the microwave transparent substrate 160 is substantially centrally disposed between the belt 110 and the bottom flanges of the walls 257A of the first housing 252A. This position is illustrated by a central plane 162 passing along and generally aligning with the first surface 161. Energy transfer to the ink jetted material is improved when exposed to electric fields having large horizontal components, parallel to the first surface 161, as occurs when the first surface 161 is generally aligned with the central plane 162.

Figure 2C:
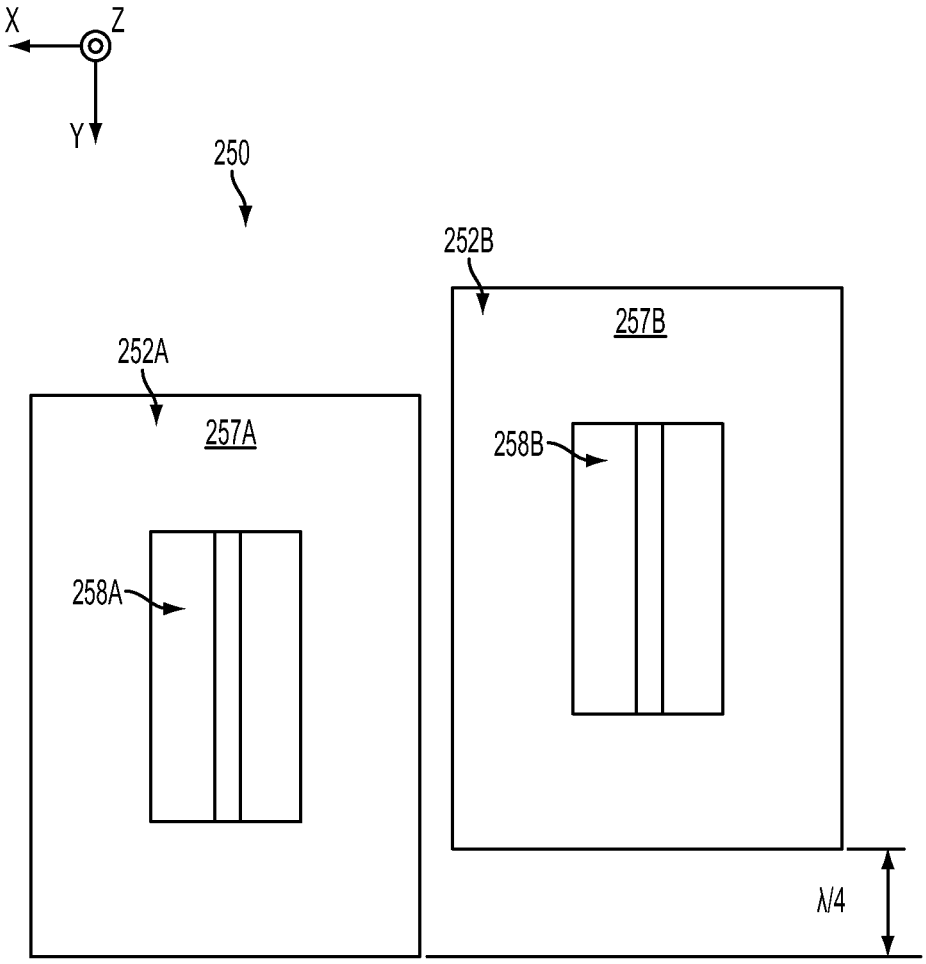
FIG. 2C is a plan view of a base potion of the microwave apparatus of FIG. 2.

FIG. 2C shows a plan view of the base of the microwave apparatus 250 including the slots 258A and 258B of the first and second housings 252A and 252B. As shown in FIG. 2C, the first housing 252A is offset from the second housing 252B by a cross-process distance of $(X*\lambda)/4$, where $\lambda$ is the wavelength of the microwaves produced by the microwave emitter and X comprises an odd numbered integer.

FIG. 2C additionally illustrates the configuration of the slots 258A and 258B according to one example embodiment. Other slot shapes (e.g., circular antenna, cross antenna and horn antenna) and sizes are known and can be used in other embodiments. The combined length of the slots 258A and 258B in the cross-process direction can be slightly greater than the length of the area being printed, such that all of the ink jetted material deposited in the cross process direction is approximately centrally located beneath the slots 258A and 258B.

Figure 3:
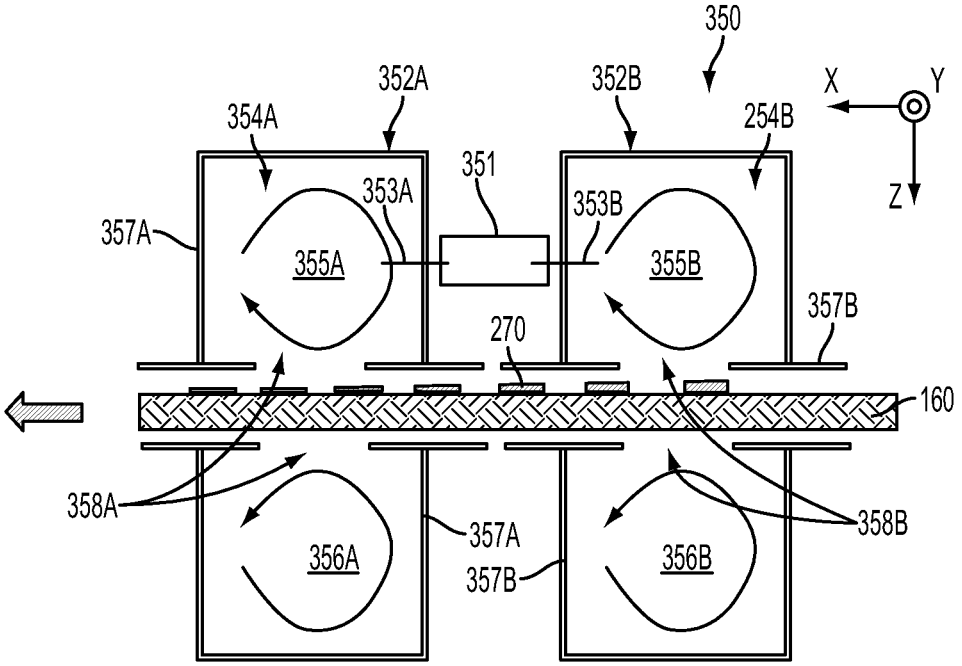
FIGS. 3 and 3A illustrate another embodiment of the microwave apparatus disposed to both sides of the microwave transparent substrate.
Figure 3A:
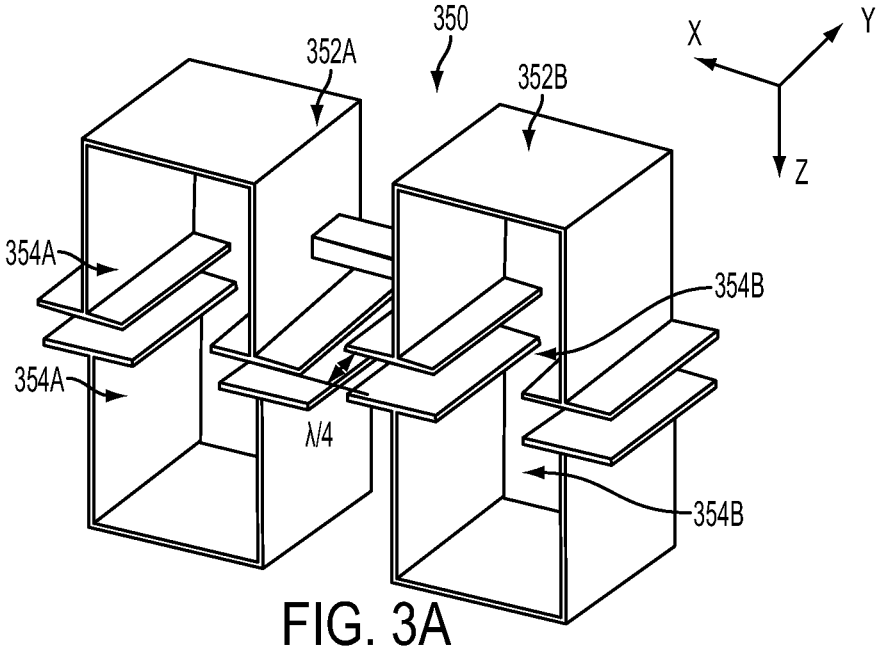

FIGS. 3 and 3A illustrate another embodiment of a microwave apparatus 350. As shown in FIG. 3, the microwave apparatus 350 is disposed to both sides of the microwave transparent substrate 160 such that the microwave transparent substrate 160 passes through the microwave apparatus 350 in the process direction (x direction) during operation.

The microwave apparatus 350 illustrated in FIG. 3 includes a microwave emitter 351, a first housing 352A, a second housing 352B, a first coupler 353A, and a second coupler 353B. The first housing 352A includes a first resonant cavity 354A that further includes a launch cavity 355A, a reflecting cavity 356A. The first housing 352A also includes walls 357A and slots 358A. The second housing 352B includes a second resonance cavity 354B that further includes a launch cavity 355B, a reflecting cavity 356B. The second housing 352B also includes walls 357B and slots 358B.

Cavities 355A and 356A can also be seen as part of the same overall cavity but supporting a multi-node mode, such as a TE102 mode that has a substantially lateral electric field maximum at the plane of the substrate 160. Cavities 355A and 356A can have different extents in the z direction so long as the plane of the substrate 160 is at or near an electric field maximum (a magnetic field minimum).

The operation of the microwave apparatus 350 is substantially similar to the operation of the microwave apparatus 250 described in reference to FIGS. 2-2C, and therefore, will not be discussed in great detail. The disposition of the first housing 352A relative to the microwave transparent substrate 160 disposes the launch cavity 355A on a first side of the microwave transparent substrate 160 and disposes the reflecting cavity 356A on a second opposing side of the microwave transparent substrate 160 such that the microwave transparent substrate 160 is disposed between the launch cavity 355A and the reflecting cavity 356A. Both the launch cavity 355A and the reflecting cavity 356A have slots 358A that comprise outlets for microwave energy to pass to the microwave transparent substrate 160 and ink jetted material 270.

Similarly, the launch cavity 355B is disposed on a first side of the microwave transparent substrate 160 and the reflecting cavity 356B is disposed on a second opposing side of the microwave transparent substrate 160 such that the microwave transparent substrate 160 is disposed between the launch cavity 355B and the reflecting cavity 356B. In the embodiment shown, the microwave transparent substrate 160 is substantially centrally disposed between the walls 357B of the second housing 352B (i.e, between the walls that form the launch cavity 355B and the walls 357B that form the reflecting cavity 356B). The launch cavity 355B and the reflecting cavity 356B have slots 358B that comprise outlets for microwave energy to pass to the microwave transparent substrate 160 and ink jetted material 270.

In operation, an amount of microwave power is output from both the launch cavity 355A and the reflecting cavity 356A to reduce a moisture content of the ink jetted material via the slots 358A. Cavities 352A and 352B are offset from each other by a cross-process distance of $(X*\lambda)/4$, where $\lambda$ is the wavelength of the microwaves produced by the microwave emitter and X comprises an odd valued integer. The total amount of microwave power output to the ink jetted material from the cavities 352A and 352B is substantially constant as measured along the second direction which is transverse to the first process direction.

Figure 4:
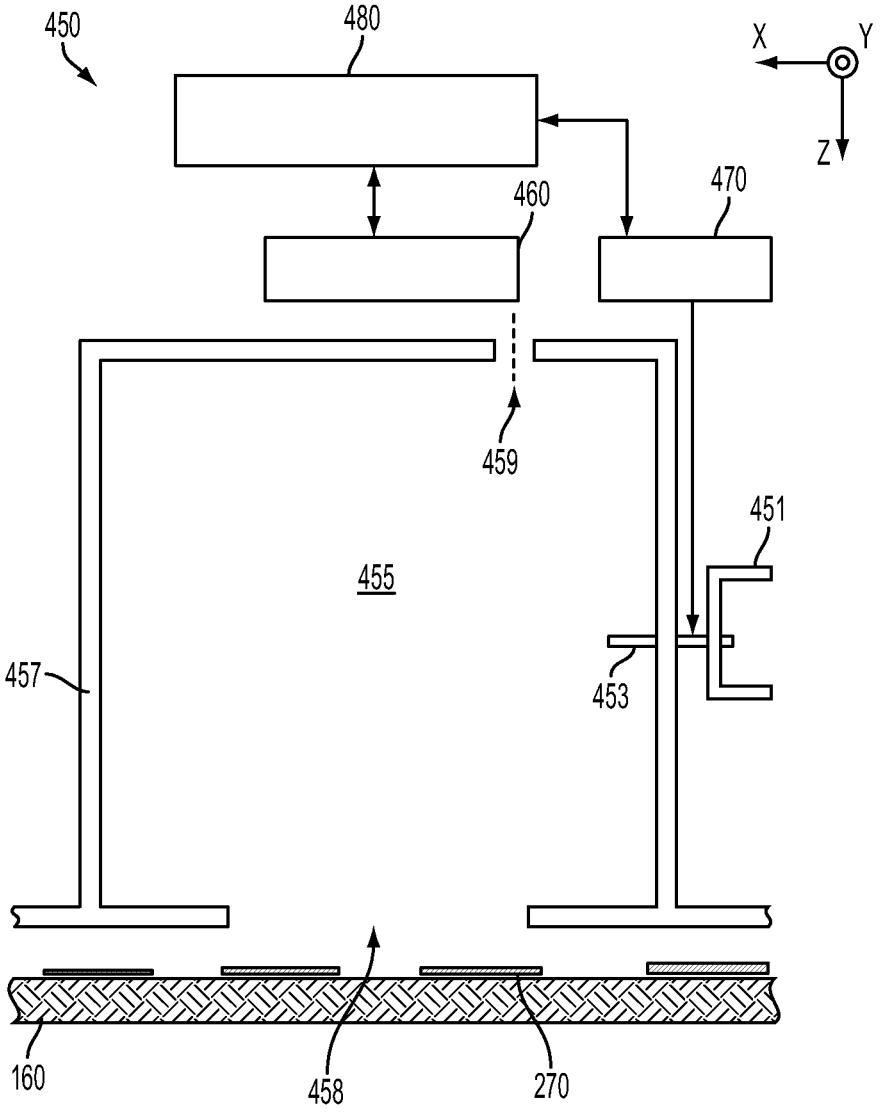
FIG. 4 illustrates a portion of yet another embodiment of the microwave apparatus, and additionally illustrates a tuning device, sensor, and control system; and The figures are not necessarily to scale. Like numbers used in the figures refer to like components. However, it will be understood that the use of a number to refer to a component in a given figure is not intended to limit the component in another figure labeled with the same number.

FIG. 4 shows a launch cavity 455 for another embodiment of a microwave apparatus 450 disposed adjacent the microwave transparent substrate 160 and ink jetted material 270. Only a portion of the microwave apparatus 450 is illustrated in FIG. 4 and includes a microwave emitter 451, a waveguide 453, walls 457 and a slot 458. Additionally, the embodiment of FIG. 4 includes at least one hole 459, a sensor 460, a tuning device 470, and a control system 480.

Holes 459 extend through the walls 457 of the launch cavity 455. In one embodiment, the holes 459 have a diameter much less than (λ/4) for allowing water vapor to exhaust from the launch cavity 455 but containing the microwave energy within the cavity. The sensor 460 comprises a moisture sensor and is disposed to receive an amount of water vapor exhausted from the launch cavity 455. Alternatively, sensor 460 can be an optical sensor of ink moisture content located either up- or down-stream from the cavities. The control system 480 is operationally configured to monitor the moisture content of the ink jetted material 270 via the sensor 460 and control the tuning device 470. In some embodiments, the control system 480 is a closed loop control system capable of providing real time feedback based upon the amount of moisture content of ink jetted material inferred from the sensor 460 readings.

The tuning device 470 can vary the energy of the microwaves seen by the ink jetted material 260 by varying the coupling, wavelength (λ), and/or power supply output. In some cases, the tuning device 470 comprises one or more of a phase shifter, a twin stub tuner, a three stub tuner, a four stub tuner, an iris plate, and an EH tuner, one or more adjustment mechanisms, and a variable power source.

For example, the energy produced in the microwave emitter 451 may be passed through a circulator and/or the waveguide 453 having matching iris plates in order to tune the frequency and amplitude to desired values or ranges. In some cases, the microwave emitter 451 can also include apparatuses for phase shifting the microwaves to optimize coupling of the microwave energy to the ink jetted material. Such apparatuses can include one or more of the twin stub tuner, the three stub tuner, the four stub tuner, and the EH tuner.

In some cases the tuning device 470 may include one or more mechanical adjustment mechanisms that can change dimensions or impede reflected energy within the launch cavity 455 and other cavities of the microwave apparatus 450. The mechanical adjustment mechanisms can comprise one or more of a movable piston capable of adjusting a dimension of the launch cavity 455 and/or a circulator. In some cases, the movable piston may be oriented to adjust the effective length of the launch cavity 455 or reflecting cavity (not shown) in the process direction (x direction) In other embodiments, the movable piston may be oriented to adjust other dimensions of the launch cavity 455 and other cavities in the y direction and z direction. In some cases the movable piston can be used in combination with iris plates to adjust the length of iris plates, allowing for tuning of the launch cavity 455 in relation to the microwave frequency. In some instances an amplitude of an adjustment to the dimension is greater than or equal to (λ/4) and a period of adjustment is less than a time for the microwave transparent substrate 160 to be transported by a length of detectable image variation.

Microwave apparatus 450 can also utilize the phase shifter to modulate the frequency of the energy emitted by microwave emitter 451. The phase shifter may include electrically (e.g., diodes, dielectrics, and ferro-electric materials), magnetically (e.g., ferritic compounds), and mechanically controlled phase shifters. In some instances, the phase shifter varies the wavelength (λ) by a factor of two (an octave). The phase shifter can be used in a tuning circuit with a circulator in some cases. Circulators are described, for example, in U.S. Pat. Nos. 4,771,252 and 5,384,556, which are hereby incorporated by reference. U.S. Pat. No. 4,162,459, which is hereby incorporated by reference, describes a tuning circuit including a circulator and a phase shifter.

In some embodiments, a network analyzer or an e-field probe may also be used to tune the microwave heating apparatus. A network analyzer, typically used when the microwave emitter 451 is not operational, may inject a small amount of microwave energy into the system and analyze back reflection. The back reflection may be reduced or minimized by altering the position of the movable piston, or by altering the settings on the phase shifter or tuning devices that may be used. An e-field probe may measure the electric field within the resonant cavity. The system may be tuned by altering the settings of the tuning device 470 to alter the electric field within the resonant cavity.

Systems, devices or methods disclosed herein may include one or more of the features, structures, methods, or combinations thereof described herein. For example, a device or method may be implemented to include one or more of the features and/or processes described below. It is intended that such device or method need not include all of the features and/or processes described herein, but may be implemented to include selected features and/or processes that provide useful structures and/or functionality.

Various modifications and additions can be made to the preferred embodiments discussed above. Accordingly, the scope of the present disclosure should not be limited by the particular embodiments described above, but should be defined only by the claims set forth below and equivalents thereof.

What is claimed is:

1. An ink jet printer, comprising:

a microwave transparent substrate operationally movable along a first direction and adapted to receive an ink jetted material thereon, the microwave transparent substrate comprising an intermediate transfer structure of the ink jet printer configured to transfer the ink jetted material to a surface of a final substrate;

a microwave emitter configured to emit microwave power at a wavelength (λ); and a first resonant cavity and a second resonant cavity, the first resonant cavity offset in a second direction from the second resonant cavity by a distance comprising (X*λ/4), wherein X comprises an odd valued integer, each cavity having:

an outlet disposed adjacent the microwave transparent substrate and adapted to receive and output an amount of the microwave power at the outlet to reduce a moisture content of the ink jetted material as it is transported on the microwave transparent substrate, and a launch cavity in communication with a reflecting cavity such that the microwave transparent substrate is disposed between the launch cavity and the reflecting cavity, wherein the amount of microwave power output to the ink jetted material is substantially constant as measured along the second direction transverse to the first direction.

2. The ink jet printer of claim 1, wherein the microwave emitter is operationally configured to emit energy to both the first resonant cavity and the second resonant cavity.

3. The ink jet printer of claim 1, wherein the first resonant cavity and the second resonant cavity are both disposed to a first side of the microwave transparent substrate.

4. The ink jet printer of claim 3, further comprising a support plate disposed at a distance less than (λ/4) from an outlet of each of the first resonant cavity and the second resonant cavity.

5. The ink jet printer of claim 4, wherein the support plate is electrically conductive, and wherein the distance comprises between 3% and 10% of (λ/4).

6. The ink jet printer of claim 1, further comprising:

at least one tuning device; and a control system operationally configured to control the at least one tuning device in response to the moisture content of the ink jetted material.

7. The ink jet printer of claim 6, further comprising a moisture sensor disposed to receive an amount of water vapor exhausted the at least one cavity or disposed to directly detect the moisture content of the ink jetted material, and wherein the control system is a closed loop control system capable of providing real time feedback based upon at least one of the amount of water vapor exhausted from the at least one cavity and the moisture content of the ink jetted material.

8. The ink jet printer of claim 6, wherein a wall of the at least one cavity includes at least one hole having a diameter less than λ/4 for allowing water vapor to exhaust from the at least one cavity.

9. The ink jet printer of claim 6, wherein the at least one tuning device comprises one or more of a phase shifter, a twin stub tuner, a three stub tuner, a four stub tuner, an iris plate, and an EH tuner, one or more adjustment mechanisms, and a variable power source.

10. The ink jet printer of claim 9, wherein the at least one tuning device varies the wavelength (λ) by a factor of two.

11. The ink jet printer of claim 9, wherein the one or more mechanical adjustment mechanisms comprise a movable piston capable of adjusting a dimension of the at least one cavity and a circulator.

12. The ink jet printer of claim 1, wherein the intermediate structure is a belt of the ink jet printer.

13. A method for reducing a moisture content of ink jetted material, comprising:

providing a microwave apparatus and a microwave transparent substrate, wherein the microwave transparent substrate is operationally movable along a first direction relative to the microwave apparatus to transport an ink jetted material, the microwave transparent substrate comprising an intermediate transfer structure of the ink jet printer configured to transfer the ink jetted material to a final substrate; and exposing the ink jetted material as it is transported on the microwave transparent substrate to an amount of power produced by the microwave apparatus, wherein the amount of power is modally averaged along a second direction transverse to the first direction in a manner to provide a same integrated power at each location of the microwave transparent substrate in the cross process direction, wherein the microwave apparatus includes at least one cavity and further comprising adjusting a dimension of the at least one cavity, and wherein a period of adjustment is less than a time for the microwave transparent substrate to be transported by a length of detectable image variation.

14. The method of claim 13, wherein the microwave apparatus includes:

providing a microwave emitter configured to emit power at a wavelength (k), and providing at least one cavity that includes a first resonant cavity and a second resonant cavity, wherein the first resonant cavity is offset in the second direction from the second resonant cavity by a distance comprising (X*λ/4), wherein X comprises an odd numbered integer.

15. The method of claim 13, wherein an amplitude of an adjustment to the dimension is greater than or equal to (λ/4).

16. The method of claim 13, further comprising tuning a frequency and/or amplitude of energy produced by the microwave apparatus using at least one tuning device.

17. The method of claim 16, wherein the at least one tuning device comprises at least one of an iris plate, a phase shifter, an EH tuner, a twin stub tuner, a three stub tuner, a four stub tuner, and a movable piston to adjust a dimension of at least one cavity of the microwave apparatus.

18. The method of claim 13, further comprising controlling at least one of a frequency of the amount of energy, a rate of movement of the microwave transparent substrate along the first direction, a dimension of at least cavity of the microwave apparatus, and a power output of a microwave emitter to reduce the moisture content of the ink jetted material to a desired level.

19. The method of claim 18, further comprising:

sensing the moisture content of the ink jetted material; and analyzing the sensed moisture content and using a control system to adjust the at least one of the frequency of the amount of energy, the rate of movement of the microwave transparent substrate along the first direction, the dimension of at least cavity of the microwave apparatus, and the power output of the microwave emitter.

20. A system for reducing a moisture content of ink jetted material, comprising:

a microwave transparent substrate operationally movable along a first direction and adapted to receive an ink jetted material on a first surface, the microwave transparent substrate comprising an intermediate transfer structure of the ink jet printer configured to transfer the ink jetted material to a surface of a final substrate;

a microwave emitter configured to emit microwave power at a wavelength (λ);

a microwave apparatus having an interaction region with the microwave transparent substrate and the ink jetted material transported on the microwave transparent substrate, wherein the microwave apparatus is configured such that an integrated microwave power in the interaction region is substantially constant as measured along a second direction transverse to the first direction;

a moisture sensor; and a control system configured to provide feedback based upon an output of the moisture sensor.

* * * * *